US008640897B2

(12) United States Patent
Samson

(10) Patent No.: US 8,640,897 B2
(45) Date of Patent: Feb. 4, 2014

(54) VENTED TEAT

(76) Inventor: Ilan Zadik Samson, London (GB)

( * ) Notice: Subject to any disclaimer, the term of this patent is extended or adjusted under 35 U.S.C. 154(b) by 1271 days.

(21) Appl. No.: 11/909,511

(22) PCT Filed: Mar. 31, 2005

(86) PCT No.: PCT/GB2005/001264

§ 371 (c)(1),
(2), (4) Date: Sep. 24, 2007

(87) PCT Pub. No.: WO2006/103379

PCT Pub. Date: Oct. 5, 2006

(65) Prior Publication Data

US 2010/0163508 A1 Jul. 1, 2010

(51) Int. Cl.

| | |
|---|---|
| ***A61J 9/00*** | (2006.01) |
| ***A61J 11/00*** | (2006.01) |
| ***A61J 11/02*** | (2006.01) |
| ***A61J 9/04*** | (2006.01) |
| ***B65D 51/16*** | (2006.01) |
| ***B65D 35/28*** | (2006.01) |

(52) U.S. Cl.
USPC ... 215/11.5; 215/11.1; 215/11.4; 220/203.16; 222/95

(58) Field of Classification Search
USPC ..... 215/11.4, 11.5, 11.1; 222/95; 220/203.16
See application file for complete search history.

(56) References Cited

U.S. PATENT DOCUMENTS

| | | | | | |
|---|---|---|---|---|---|
| 805,641 | A | * | 11/1905 | Gallagher | 215/11.5 |
| 2,616,581 | A | * | 11/1952 | Madsen et al. | 215/11.5 |
| 3,556,122 | A | | 1/1971 | Laerdal | |
| 5,678,710 | A | * | 10/1997 | Sheu | 215/11.5 |
| 5,860,541 | A | * | 1/1999 | McIntyre et al. | 215/11.4 |
| 2004/0256345 | A1 | | 12/2004 | Lundquist | |

FOREIGN PATENT DOCUMENTS

| | | |
|---|---|---|
| CH | 249743 | 7/1947 |
| DE | 29906849 | 7/1999 |
| GB | 2412114 | 3/2004 |
| WO | 9602222 | 2/1996 |

* cited by examiner

*Primary Examiner* — Anthony Stashick
*Assistant Examiner* — Andrew T Kirsch
(74) *Attorney, Agent, or Firm* — Edwin D. Schindler

(57) ABSTRACT

A teat for a feeding bottle has a one-way valve located remotely from the nipple of the teat to allow air to enter the feeding bottle to replace liquid sucked out of the bottle through the nipple while preventing liquid from leaking from the bottle. The one-way valve comprises an inwardly-oriented depression having opposed mutually inclined side walls meeting along a ridge having a slit. In the invention, when undeflected, the side walls make line contact with one another at the ridge and the thickness of the side walls is less than 0.4 mm so that, when acted upon by an increased pressure in the feeding bottle, the side walls collapse against one another and make sealing contact along a surface that extends from the ridge in the direction away from it.

13 Claims, 3 Drawing Sheets

VENTED TEAT

Figure 1:
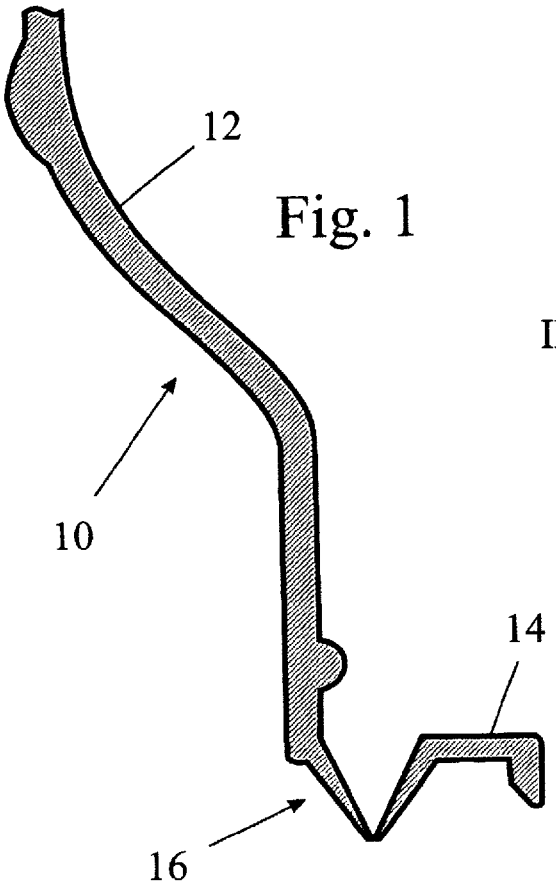

This is a national stage application filed under 35 USC 371 based on International Application No. PCT/GE2005/001264 filed Mar. 31, 2005.

The present invention relates to a teat for a feeding bottle.

Babies can suckle from their mother's breast continuously without the need to vent. For this reason, when young babies move on to sucking from a feeding bottle teat they are not yet aware of the need to vent. If the baby does not stop sucking to allow air to enter the feeding bottle, the pressure in the bottle drops and the resulting counter suction makes it more difficult for the baby to suck liquid out of the bottle. Apart from frustrating the baby's efforts to drink, this has two more serious effects. First, with the need to apply an increasing suction force, the baby's lips become unable to make an effective seal around the teat and the baby ends up swallowing air with the liquid and the trapped gas gives the baby colic. Second, the dome of the teat collapses inwards, making it difficult for the baby's lips to maintain a grip on the nipple.

Numerous attempts have been made to vent feeding bottle teats. Teats are made from a resilient material such as rubber or a silicone and previous attempts usually involved making a small slit or hole somewhere in the teat at a location remote from the nipple. It is important with any venting opening that it should not allow liquid to leak out of the feeding bottle and a trade-off then exists between the ease of opening for venting and leak-prevention.

It is common practice to prevent leakage by making the slits/holes very small, and in thick walls. Specifically, the leak-prevention is made to rely on the strength of the walls to maintain the slit/holes in a closed position in the absence of suction.

A common improvement involves placing the slit at the apex of an inwardly-oriented depression such that the pressure of liquid trying to leak out would tend to force the lips towards each other.

Such prior art attempts have not proved entirely successful for the following reasons. The thickness of the valve material causes the need of a substantial suction level to exist in the bottle before the slit opens for venting. Even then, it hinders sufficient opening for an adequate venting air flow rate. The thickness of the valve material also limits the transmission of inside pressure to aid the closing of the slit. The usual small size of the inward depression does not have sufficient area over which to build up into an effective closing force, and the short length of the slit —to limit leakage —is then also too small to afford sufficient opening for adequate venting.

To overcome the above problems DE 29906849 U1describes a teat for a feeding bottle having a one-way valve located in the wall of the teat to allow air to enter the feeding bottle to replace liquid sucked out of the bottle through the nipple while preventing liquid from leaking from the bottle, wherein the one-way valve comprises an inwardly-oriented depression having opposed mutually inclined side walls that, at their inward end, are bent over towards each other to meet along a slit. This arrangement causes the weight of any liquid within the bottle, while attempting to escape through the valve, to urge the edges of lips of the slit, and the edges only, into a closed state. The reason for this is the known practice of concentrating sealing regions onto a line, known as (arid cited as such in DE 29906849) a "lip seal".

It has also been proposed in CH 249743 to attach to a teat a separately formed venting valve comprising as a valve element a thin-walled cylindrical tube. Opposite sides of the wall of the tube are expected to collapse against one another under the action of the surface tension of the liquid. Aside from the fact that the valve element cannot be formed as part of the teat, conflicting constraints on the diameter and wall thickness of the tube make it difficult, if not impossible, to achieve efficient venting at the same time as avoiding both the risk of leakage and the risk of inversion of the tube by the pressure in the bottle.

A disadvantage of the above proposal is that the reliance on a lip seal makes it susceptible to particles in the liquid becoming lodged between these lips, risking undesirable leakage.

The present invention seeks therefore to provide a teat that is tolerant of small impurities and in which prevention of leakage through the venting valve does not rely on the strength of the walls and the smallness of the slit to maintain the opening closed in the absence of suction. As a result it makes it possible to enhance both the ease of venting as well as the sealing efficiency rather than one at the expense of the other.

According to the present invention, there is provided a teat for a feeding bottle having a one-way valve located remotely from the nipple of the teat to allow air to enter the feeding bottle to replace liquid sucked out of the bottle through the nipple while preventing liquid from leaking from the bottle, wherein the one-way valve comprises an inwardly-oriented depression having opposed mutually inclined side walls meeting along a ridge having a slit, characterised in that when undeflected the side walls make line contact with one another at the ridge and in that the thickness of the side walls is less than 0.4 mm whereby when acted upon by an increased pressure in the feeding bottle the side walls collapse against one another and make sealing, contact on an interface surface that extends from the ridge in the direction away from it.

In the preferred embodiment of the invention, the depth of the depression is in excess of 4 mm and the slit has a length exceeding 3 mm.

By forming the one-way valve in the preferred embodiment of the invention with at least one large area (4 mm×4 mm) thin-section (less than 0.4 mm thick) side wall and providing a long (3 mm) slit along the ridge of the depression, a force is generated by the weight of the liquid within the bottle attempting to escape through the valve, which collapses the side walls towards one another and maintains the slit in the ridge closed. The greater the water pressure, the greater the force applied to maintain the valve closed. Thus, the valve does not rely on the resilience of its own walls to remain shut, nor on the smallness of the slit to minimize leaks, but on the pressure of the liquid trying to escape.

When the pressure of the liquid is below the ambient atmospheric pressure (as the infant is sucking on the teat) the thinness of the side walls allows them to separate readily to open the slit and allow air to enter the bottle, this being further assisted by the slit being long. In this way, a build up of negative pressure within the bottle is avoided. As a result, while still preventing leakage through the valve, liquid can be sucked out of the bottle easily and continuously.

The difference between the present invention and the prior art is not merely a matter of size or dimensions but the invention relies on a different principle for its operation. This can best be appreciated from noting that, in common prior art, the sealing properties could only be enhanced be reducing the venting ability and vice versa and a compromise needed to be reached between sealing and venting. By contrast, in the present invention, there is no need for any such compromise as the venting can be improved while enhancing the sealing, thereby allowing both functions to be optimised.

It should be noted though, that the size of such a valve cannot be increased indefinitely because if it were too large, e.g. a base area in excess of 1 $cm^2$ (particularly with the thin walls) there is a risk of the excessive deformation of the valve under pressure, and even its inversion.

In the preferred embodiment of the invention, the depression has a tent-like configuration with two flat generally rectangular or trapezoidal side walls meeting along the slit ridge and two generally triangular end walls.

Figure 2:
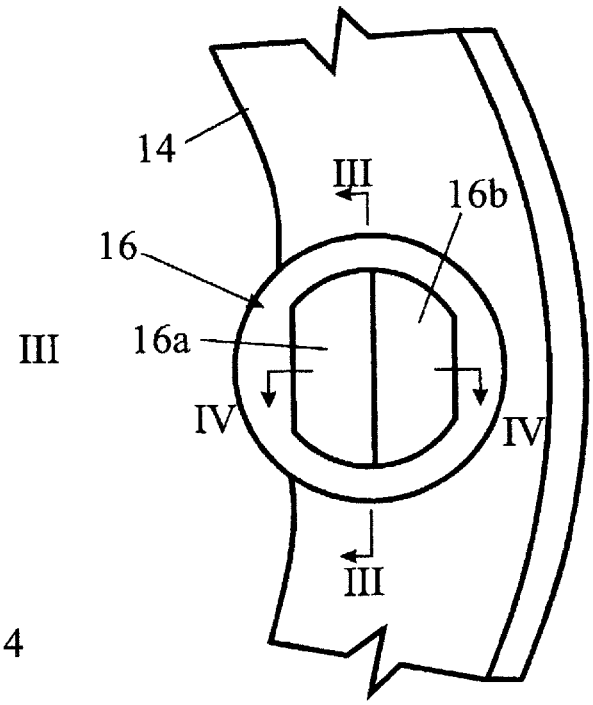
Figure 3:
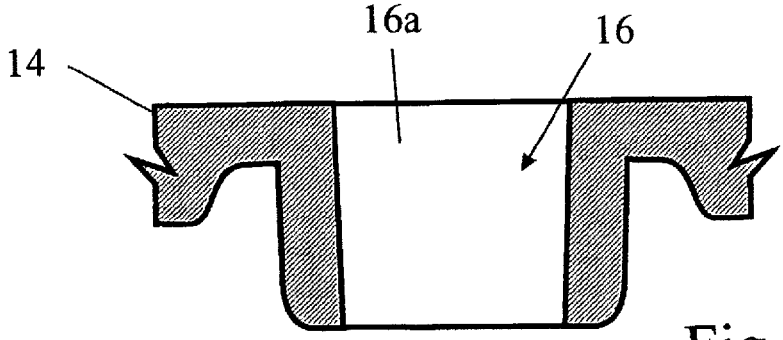
Figure 4:
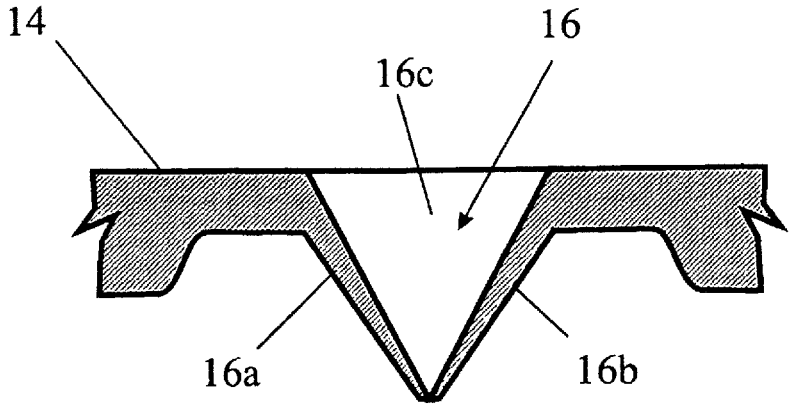
Figure 5:
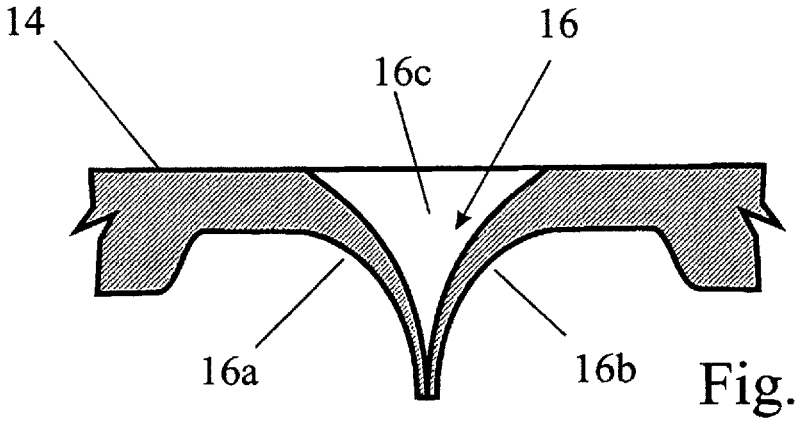
Figure 6:
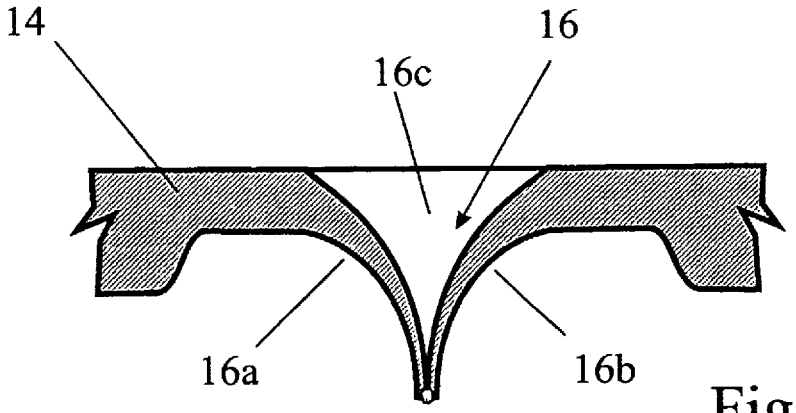
Figure 7:
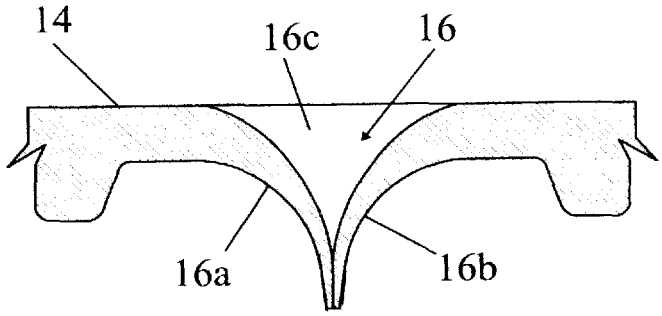

The invention will now be described further, by way of example, with reference to the accompanying drawings, in which:

FIG. 1 is a partial section through a vented teat of the invention,

FIG. 2 is a plan view from above of a detail of the teat of FIG. 1 showing the venting valve, FIG. 3 is a section taken along the line in FIG. 2, FIG. 4 is a section taken along the line IV-IV in FIG. 2 with the side walls of the valve in their undeflected state, FIG. 5 is a section similar to that of FIG. 4 showing the effect of increased pressure in the feeding bottle on the side walls of the valve, FIG. 6 is a section similar to that of FIG. 5 demonstrating the ability of the valve seal to function even when small particles are trapped in the sealing surface, and FIG. 7 is a section similar to that of FIG. 5 showing the side walls as each having a tapered thickness in the region of sealing contact toward the ridge.

The teat 10 in the drawings has a generally conventional nipple 12 and only the parts of the teat that are concerned with the venting valve are shown in the drawings. As is common, a flange 14 surrounds the base of the teat 10. The flange 14 acts as a sealing ring and, in use, is sandwiched between the top of the feeding bottle and an annular ring that is screwed on to the mouth of the bottle. The bottle and the annular ring are not shown in the drawings because they too are conventional.

The flexible material of which the teat and the venting valve are made may also be conventional being typically a silicone or elastomer that can withstand being chewed and being sterilised without suffering damage or perforation.

The one-way venting valve, which is generally designated 16 in the drawings, has a tent like structure formed by two rectangular or trapezoidal side walls 16*a* and 16*b* and two triangular end walls 16*c*. At the ridge of the tent like structure, the side walls 16*a* and 16*b* meet along a slit which opens to let air enter the feeding bottle when the pressure in the bottle is below atmospheric. However, when liquid is pressing on the side walls 16*a* and 16*b*, they are urged towards one another to close the slit and prevent the liquid from escaping.

In the present invention, the thickness of one or both of the side walls is less than 0.4 mm, preferably less than 0.3 mm. This small thickness makes the side wall(s) supple, allowing it to deform readily to open and close the valve. The responsiveness of the valve to pressure differences is enhanced by increasing the area of the side walls, this being achieved in the preferred embodiment of the invention by increasing the depth of the depression to 4 mm or more and increasing the length of the slit to 3 mm or more.

The side walls 16*a* and 16*b* need not have a uniform thickness along their entire height, but they may taper towards the ridge, as shown in FIG. 4, or at least be tapered in the region of sealing contact toward the ridge, as illustrated in FIG. 7. In this case, the thickness of the side walls could start with more than 0.3 mm or even more than 0.4 mm at the bottom, and near the slit may be even less than even 0.3 mm.

It is clear that such a construction will allow the slit to open, to vent the bottle, under very low suction. However, the leak-prevention in the absence of suction (it being only in the absence of suction that leaks can occur) is now afforded not by the strength of the side walls but because their thinness and large size allow them to respond to the pressure acted on them by the liquid that tries to escape, so as to cave in as shown in FIGS. 5,6 and 7.

In detail, three things happen that enhance the sealing efficiency. First, the large size of the side walls translates the pressure of the liquid into a larger force. Second, the thinness of the side walls makes it more responsive to being pushed closed. Third, the size of the walls make them more bendable under a given force.

The caving in of the side walls caused by the three effects described above results in the seal being extended from a line seal (FIG. 4) to a surface seal (FIGS. 5,6 and 7). In this respect it should be noted that the gap between the side walls tapers continuously without steps until they meet, so that the gap can be closed continuously to spread the sealing contact over an area as the side walls collapse. This is to be contrasted with the prior art in which the area of the lips that make sealing contact with one another does not change and only the pressure between the lips is increased. If, in the prior art, a particle is caught in a part of a lip seal, leakage will occur. However, in the present invention, as shown in FIG. 6, small particles can be tolerated because a seal will be established around them.

The described valve can be located anywhere on the teat as long as it is not too close to the nipple. The preferred locations are near the inside radius of the annular flange 14 at the base of the teat or in the side-wall of the teat.

The invention claimed is:

1. A teat for a feeding bottle having a one-way valve located remotely from the nipple of the teat to allow air to enter the feeding bottle to replace liquid sucked out of the bottle through the nipple while preventing liquid from leaking from the bottle, wherein the one-way valve comprises an inwardly-oriented depression having opposed mutually inclined flexible side walls meeting at a ridge having a slit, each of said flexible side walls having an inner surface exposed to pressure within the feeding bottle, an outer surface exposed to ambient air pressure outside the feeding bottle and a thickness measured between said inner surface and said outer surface of less than 0.4 mm, wherein the pressure on the inner surfaces of said flexible side walls is equal to the pressure on said outer surfaces, said inner surfaces and said outer surfaces of two said flexible side walls are flat and make line contact with one another at the slit, when the pressure on the inner surfaces of said flexible side walls is less than the pressure on said outer surfaces, said flexible side walls separate for opening the slit and allowing ambient air to enter the feeding bottle, and when the pressure on said inner surfaces of said flexible side walls is greater than the pressure on said outer surfaces, said flexible side walls collapse against one another, said outer surfaces of said flexible side walls making sealing contact with one another along an interface surface that spreads away from the ridge with increasing pressure on said inner surfaces of said flexible side walls.

2. A teat as claimed in claim 1, wherein at least one of the flexible side walls of the depression has a thickness not exceeding 0.3 mm.

3. A teat as claimed in claim 1, wherein the depression has a depth of at least 4 mm.

4. A teat as claimed in claim 1, wherein the line of contact of the flexible side walls at the ridge has a length in excess of 3 mm.

5. A teat as claimed in claim 1, wherein the depression has a tent configuration with two substantially, flat substantially rectangular or trapezoidal side walls meeting at the ridge and two substantially triangular end walls.

6. A teat as claimed in claim 1, wherein the two side walls have respective inner surfaces presented toward the depression and respective outer surfaces opposite the inner surfaces respectively, and when the flexible side walls are undeflected, the inner and outer surfaces are substantially flat and converge towards the ridge.

7. A teat as claimed in claim 1, wherein the thickness of the flexible side walls are uniformly tapered where said sealing contact is made toward the slit of the ridge.

8. A teat as claimed in claim 7, wherein at least one of the side walls of the depression has a thickness not exceeding 0.3 mm.

9. A teat as claimed in claim 7, wherein the side walls of the depression are tapered in thickness, having a minimum thickness not exceeding 0.4 mm adjacent the ridge.

10. A teat as claimed in claim 7, wherein the depression has a depth of at least 4 mm.

11. A teat as claimed in claim 7, wherein the line of contact of the side walls at the ridge has a length in excess of 3 mm.

12. A teat as claimed in claim 7, wherein the depression has a tent configuration with two substantially flat, substantially rectangular or trapezoidal side walls meeting at the ridge and two substantially triangular end walls.

13. A teat as claimed in claim 7, wherein the two side walls have respective inner surfaces presented toward the depression and respective outer surfaces opposite the inner surfaces respectively, and when the side walls are undeflected, the inner and outer surfaces are substantially flat and converge towards the ridge.

* * * * *